US005746330A

United States Patent [19]

DiBetta

[11] Patent Number: 5,746,330

[45] Date of Patent: May 5, 1998

[54] TOOL RACK

[76] Inventor: Geno DiBetta, 4702-8th Ave., Vienna, W. Va. 26105-3104

[21] Appl. No.: 785,402

[22] Filed: Jan. 22, 1997

[51] Int. Cl.[6] ..... A47F 7/00

[52] U.S. Cl. ..... 211/70.6; 211/96; 211/169

[58] Field of Search ..... 211/48, 96, 169, 211/70.6; 248/544, 222.51

[56] References Cited

U.S. PATENT DOCUMENTS

| | | | |
|---|---|---|---|
| 1,240,611 | 9/1917 | Smith | 211/96 |
| 1,713,704 | 5/1929 | Lobel | 211/96 |
| 2,172,902 | 9/1939 | Chalk . | |
| 2,804,212 | 8/1957 | Spitzig . | |
| 2,818,181 | 12/1957 | Crockett, Jr. . | |
| 2,923,417 | 2/1960 | Sonksen | 211/169 X |
| 3,379,484 | 4/1968 | Kling . | |
| 3,391,796 | 7/1968 | Cross | 211/169 |
| 4,170,392 | 10/1979 | Spevak . | |
| 4,285,556 | 8/1981 | Loeffel . | |
| 4,286,832 | 9/1981 | Spevak . | |
| 4,723,663 | 2/1988 | Learn . | |
| 5,038,946 | 8/1991 | Tenser et al. . | |
| 5,080,240 | 1/1992 | Williams | 211/70.6 |
| 5,139,155 | 8/1992 | Laxson . | |
| 5,292,011 | 3/1994 | Kostigain | 211/48 |

*Primary Examiner*—Jose V. Chen
*Assistant Examiner*—Janet M. Wilkins
*Attorney, Agent, or Firm*—Spencer D. Conard

[57] ABSTRACT

A tool rack assembly is provided which permits compact storage of tools above a work bench area. The assembly has a frame and a plurality of panels. The frame may be attached to a workshop wall by securing the frame to wall studs. The panels each have a top pin which is positioned within a top hole of the frame, and each have a bottom pin which is positioned within a bottom hole of the frame. The top holes are preferably forwardly and downwardly sloped and have larger diameters than that of the top pins for each insertion of the top pins into the top holes and for gravitational biting of the top pins by the top holes. The top and bottom holes are preferably arranged in a V shaped orientation with forward most center holes. The assembly provides compact and convenient storage of tools and easy insertion and removal of the panels into the frame.

9 Claims, 4 Drawing Sheets

FIG. 4
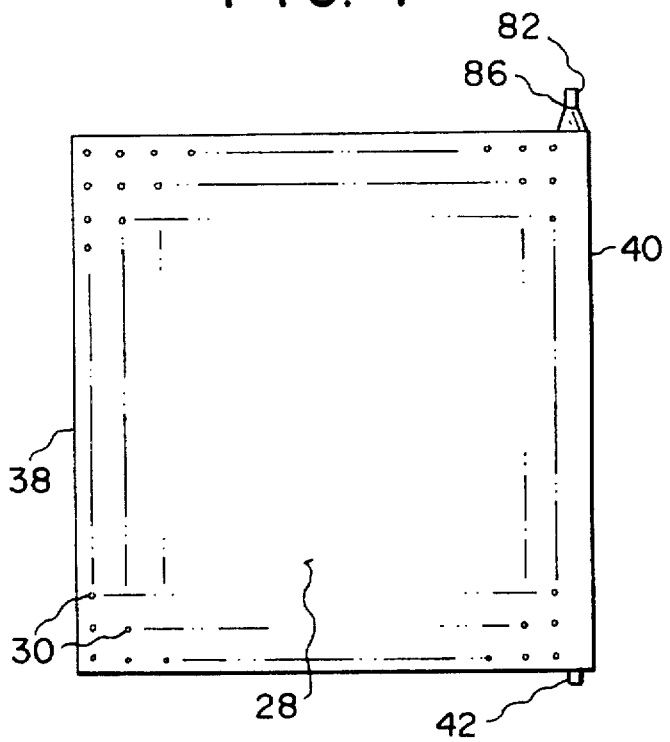
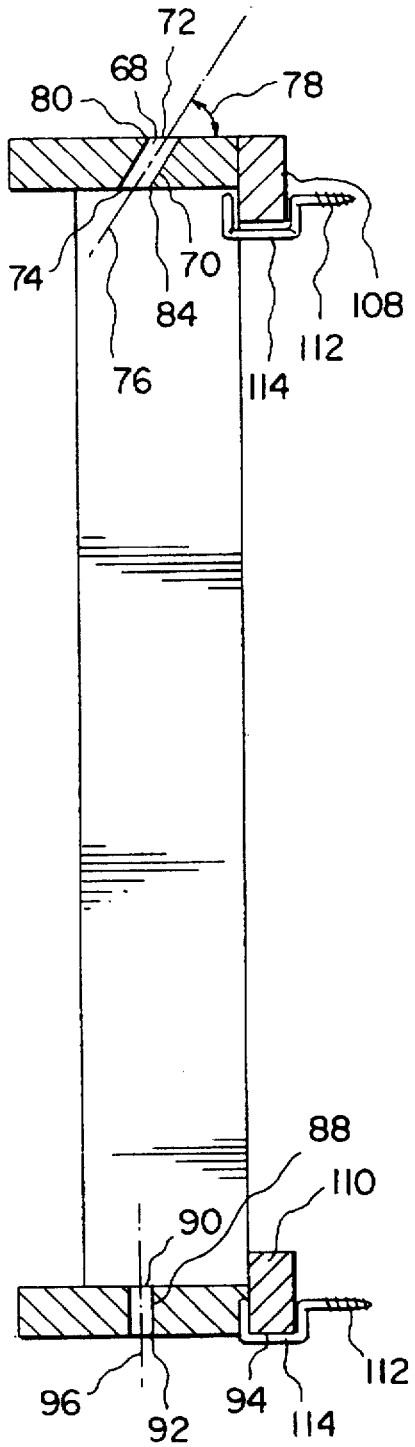
FIG. 5

TOOL RACK

BACKGROUND OF THE INVENTION

1. Field of the Invention

The present invention relates to tool racks, and more particularly relates to tool rack for containing a large number of tools in a compact area.

2. Description of the Related Art

Work shops of many home owners have peg board walls for hanging tools thereon. Hanging tools on peg boards however typically requires a large surface area of peg board in order to accommodate a large number of tools. Many of such work shops thus require the home owner to do a great deal of walking while working at a work bench and retrieving and putting away tools from the peg board wall. In some cases some of the needed tools may be ten or twenty feet away from the work bench. Tool boxes and tool drawers can provide some relieve to this problem, but tool boxes and drawers typically have a limited carrying capacity and have layers which are not always readily visible and effortlessly accessible.

Various racks and support devices have been previously disclosed. See for example, Spitzig U.S. Pat. No. 2,804,212 issued Aug. 27, 1957 which discloses a phonograph record file having spaced apart bracket members having apertures and spring clips; Loeffel U.S. Pat. No. 4,285,556 issued Aug. 25, 1981 which discloses a tool chest having a main support housing, a center member slidably mounted in the main support housing, side members pivotally mounted to the main support housing and means for supporting tools; Laxson U.S. Pat. No. 5,139,155 issued Aug. 18, 1992 which discloses a hinged panel storage system having a set of panels hinged along one side edge to rotate about a vertical axis; Learn U.S. Pat. No. 4,723,663 issued Feb. 9, 1988 which discloses a merchandise display system having a vertical pegboard to which is attached a plurality of variously positioned horizontal tracks; Chalk U.S. Pat. No. 2,172,902 issued Sep. 12, 1939 which discloses a rack for pliers secured to a wall and having free swing rods; Kling U.S. Pat. No. 3,379,484 which discloses a pivoted rack for utensils; Spevak U.S. Pat. No. 4,170,392 issued Oct. 9, 1979 which discloses an article supporting assembly in the form of a toolbox having a pivotal plate; Spevak U.S. Pat. No. 4,286,832 issued Sep. 1, 1981 which discloses an article supporting assembly in the form of a toolbox having a pivotal plate; Tenser et al U.S. Pat. No. 5,038,946 issued Aug. 13, 1991 which discloses a packaging assembly for displaying artistic gift bags and banners having a plurality of racks which are mounted for swinging movement; and Crockett, Jr U.S. Pat. No. 2,818,181 issued Dec. 31, 1957 which discloses a tie rack having arms.

While various of the racks and devices disclose structures for holding items, the above devices generally suffer from one or more of the following deficiencies: the pivot panels are not restricted from rubbing against each other; the contents held by the pivotable holders are not prevented from swinging into each other; the pivotable holders are not easily removed and installed; the assemblies are not designed for hanging above a work bench; and the assemblies are not designed for light weight construction.

SUMMARY OF THE INVENTION

The present invention involves an assembly which is easily mounted to a wall for positioning above a work bench.

The assembly has a frame which carries a plurality of panels. The panels are easily installed and/or removed from the frame, and the frame has top holes which are angled for promoting easy insertion and removal of the panels from the frame. Preferably the panels have spacing rods for maintaining a minimum spacing between adjacent panels. The panels permit a large number of tools to be stored in a compact area.

BRIEF DESCRIPTION OF THE DRAWINGS

FIG. 4 is a side elevational view of a panel according to FIG. 3;

FIG. 5 a cross-sectional view of a frame of the assembly of FIG. 1 taken along lines 5—5;

DETAILED DESCRIPTION OF THE INVENTION

Figure 1:
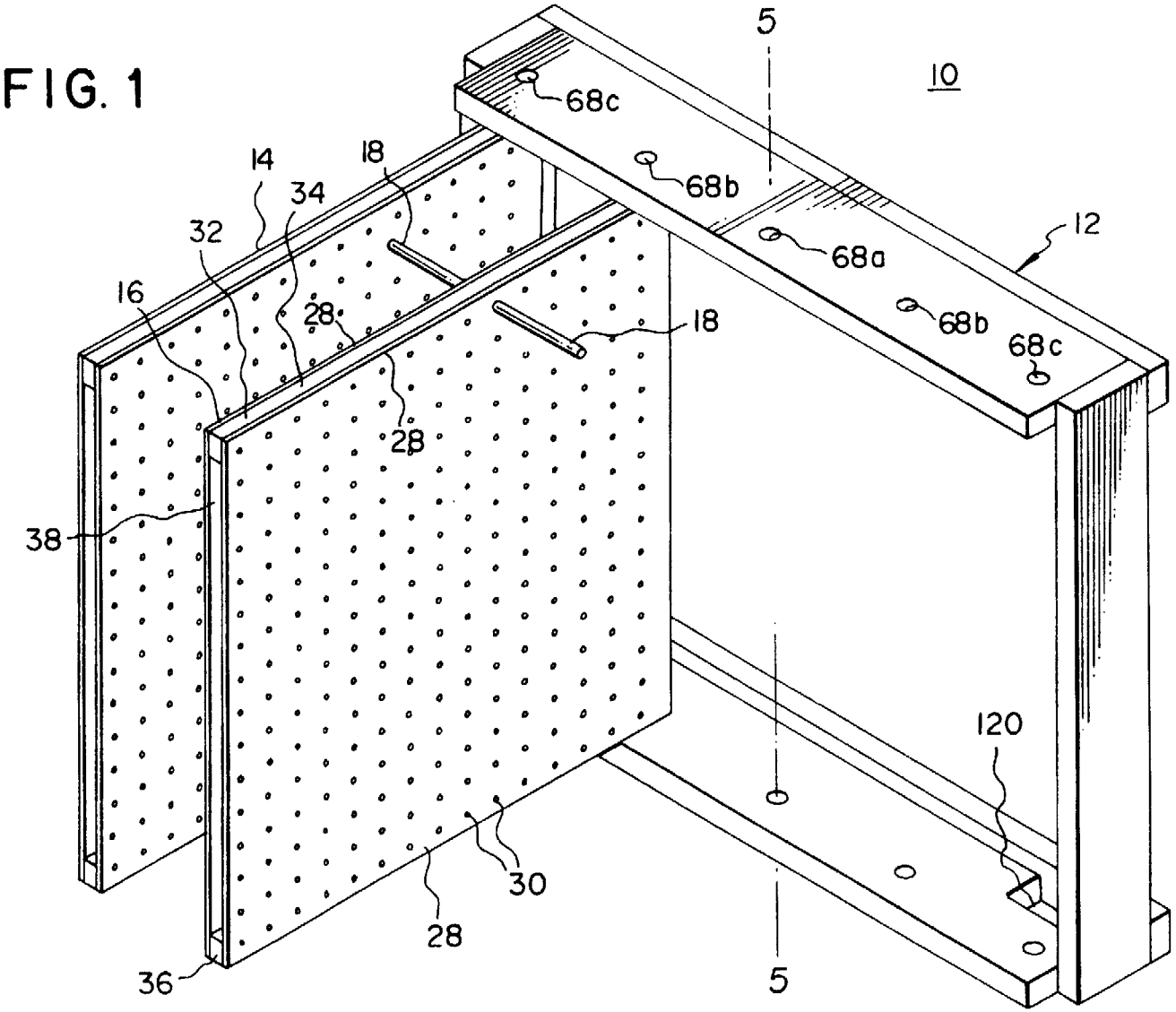
FIG. 1 is a perspective view of the assembly of the present invention.
Figure 2:
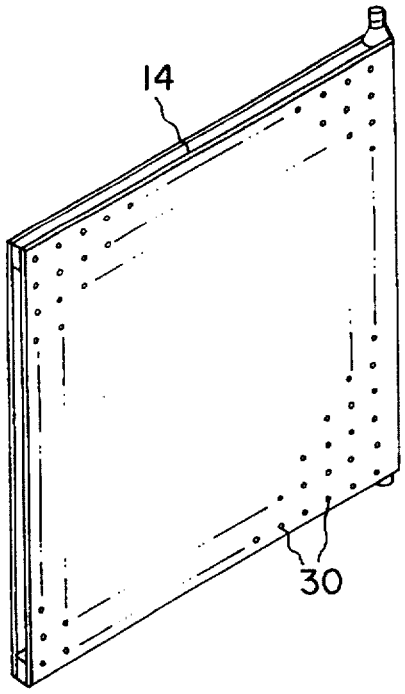
FIG. 2 is a perspective view of a panel of the assembly of FIG. 1.

As best shown in FIG. 1, a tool rack assembly (10) is provided having a frame (12) and a plurality of panels (14). At least some of the panels (14) have spacer rods (18) which function to effectively maintain at least a certain minimum distance between the panels (14). Panels having spacer rods (18) may be referred to as divider panels (16).

Figure 3:
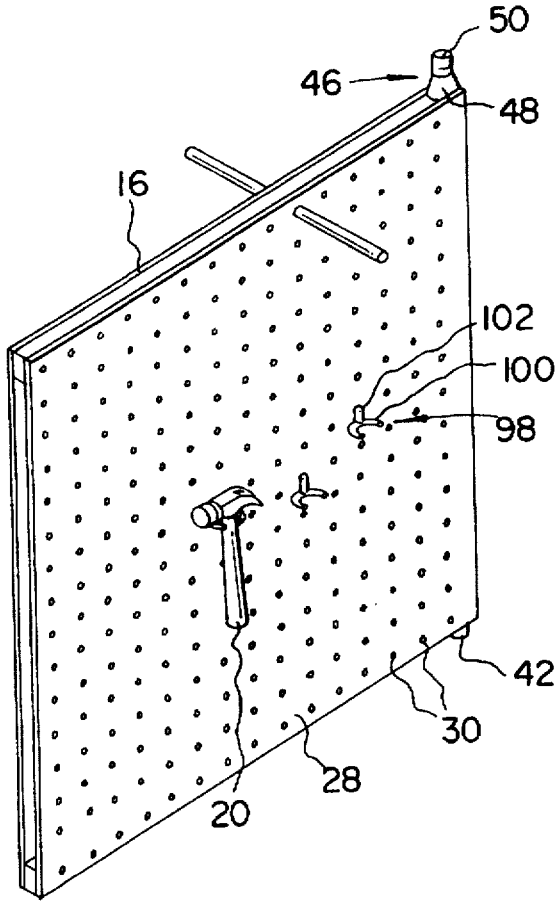
FIG. 3 is a perspective view of a panel of the assembly of FIG. 1 having spacing rods.
Figure 6:
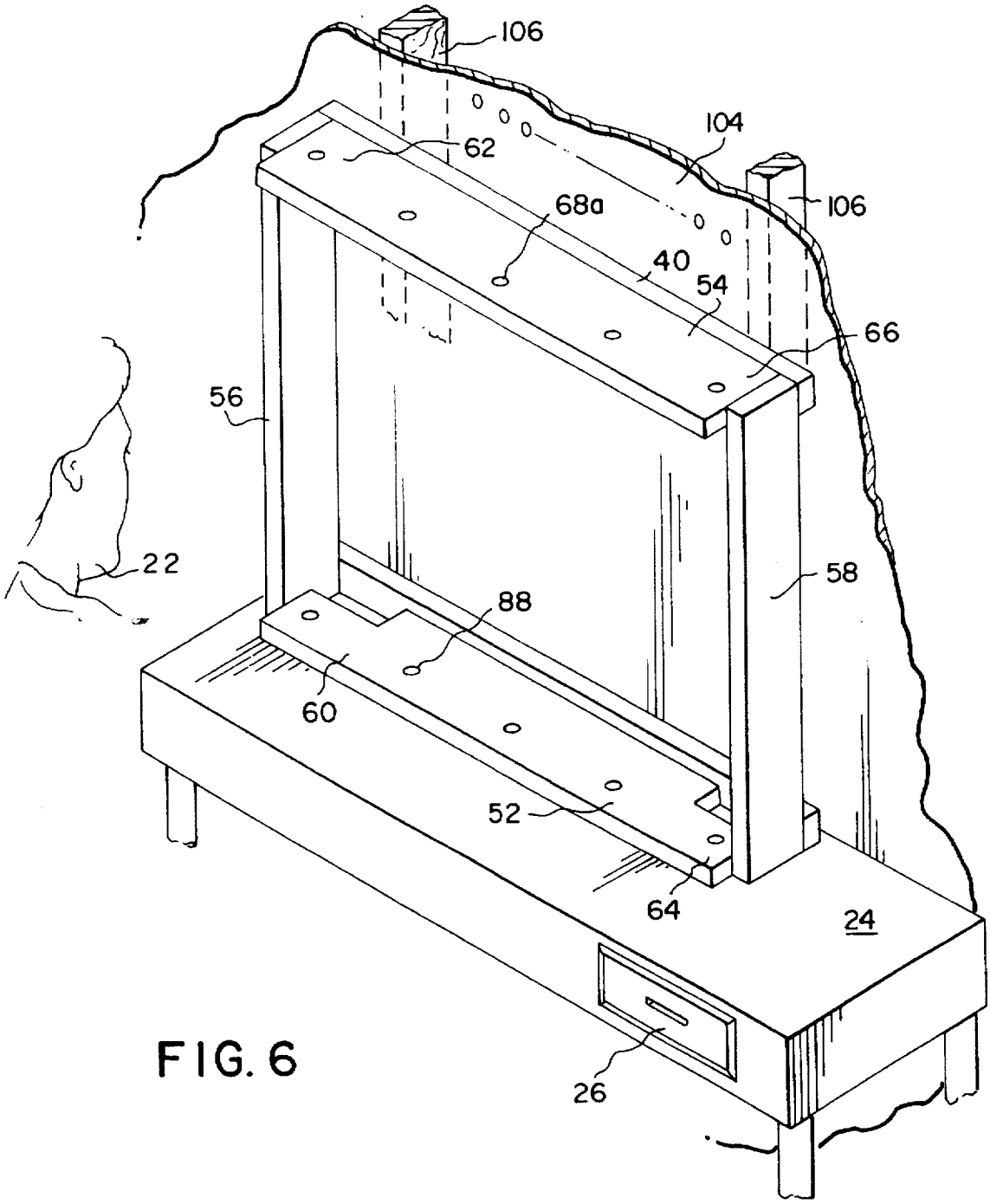
FIG. 6 is a perspective cutaway view of a frame of assembly of the present invention mounted on a wall.

As shown in FIG. 3, the assembly (10) permits the hanging and displaying of hand tools (20) in such a manner that a person (22),as shown in FIG. 6, working at a table (work bench) (24), can reach most of the tools (20) without taking a step and without the annoyance of hunting a tool in a drawer (26). The tools (20) can be arranged and displayed in whatever manner a person (22) wishes. Each panel (14) has a pair of spaced apart vertical (parallel, rectangular) boards (28) which are preferably in the form of peg boards (28) having a plurality of holes (30) arranged in a matrix fashion forming rows and columns of holes (30). The pair of spaced apart boards (28) of each panel (14) are preferably maintained in their spaced apart orientation by the use of a spacing element (32) preferably having a top horizontal spacing strip (34), a bottom horizontal spacing strip (36), and a pair of vertical spacing strips (front spacing strip (38), rear spacing strip (40)) extending between the top (34) and bottom (36) spacing strips thereby forming a hollow rectangle of spacing strips. A bottom cylindrical pin (42) extends downwardly from the rear of the bottom (44) of the panel (14) and a top pin unit (46) extends upwardly from the rear top (35) of the panel (14). The top pin unit (46) has an upwardly tapered rectangular base (48) attached to the top of the panel (14) and a cylindrical top pin (50) extending upwardly from the base (48).

The frame (12) has a bottom horizontal cross piece (52), a top horizontal cross piece (54), a left side support (56) extending from the left side (60) of the bottom cross piece (52) to the left side (62) of the top cross piece (54), and has a right side support (58) extending from the right side (64) of the bottom cross piece (52) to the right side (66) of the top cross piece (54). The frame (12), spacer element (32), and pin(42) and top pin unit (46) may be made of common softwood or hardwood, for example they may be made of pine.

As shown in FIGS. 1 and 6, the top cross piece (54) has a plurality of top holes ports (holes) (68) which are arranged in a spaced relationship, preferably in a V arrangement with the center hole (68*a*) being in the forward most position and each sequential hole (68b,c) outwardly therefrom being in an increasingly rearward position. Optionally, but less preferably the holes (68) may be arranged linearly in a row.

The top holes (68) have a downwardly forwardly inclined bore (70) for permitting easy insertion and removal of panels (14, 16), and the weight of the panel (14, 16) provides a gravitationally forward bias to the top pin (50) to maintain forced engagement between the front of the bore (70) and the pin (50) even though the bore (70) is at least 10% larger in diameter than the diameter of the pin (50). In other words, the top holes (68) each preferably have a circular top opening (72) which is located vertically above and rearward of a circular bottom opening (74). An angled bore (70) extends from the top opening (72) forwardly and downwardly to the bottom opening (74). Each bore (70) has an angled central axis (76) having an angle (alpha, 78) of orientation of at between 75 to 88 degrees in a rearward direction from horizontal. The top opening (72) has a frontmost portion (80)(either straight or curvilinear) which engages a top section (82) of the top pin (50), and the bottom opening (74) has a rearmost portion (84) which engages a bottom section (86) of the top pin (50) when the panel (14) is in position. Gravitational forces cause the top pin (50) to engage the frontmost portion (80) and rearmost portion (84). Alternatively, the top holes (40) have bores (46) which may be in the form of rectangular slots which slope downwardly and forwardly thereby providing linear (straight) frontmost portions and linear (straight) rearmost portions for gravitationally biting the top pin (50)thereby providing a firm (non-wobbling) hold on the top pin (50) which permits rotation of the panel (14). Also, alternatively, the top holes may be enlarged and bore vertical, although the preferred embodiment utilizes the slanted bore.

The bottom cross piece (52) has a plurality of bottom holes (88) positioned directly beneath the bottom openings (74) of the top holes (68). The bottom holes have a circular top opening (90) and preferably a circular bottom opening (92) wherein the bottom opening (92) is directly below the top opening (90). A vertical bore (94) extends from the top opening (90) to the bottom opening (92) thereby providing the bore (94) with a vertical central axis (96).

The panels (14) have hollow interiors between the spaced apart boards (28). Tool holding wire inserts (98) (conventional inserts) may be used with the panels(14) by inserting the inserts (98) into peg board holes (30) to gravitationally lock the insert (98) into position thereby causing an arm (100) of the insert to extend horizontally from the board(28). The hollow interior permits the leg (102) of the insert (98) to be inserted into the board holes (30) and extend behind the board (28) and into the interior of the panel(14).

The assembly (10) may be attached to a workshop wall (104) by attaching the frame (12) to wall studs (106). The frame (12) preferably has an upper rear horizontal brace piece (108) which extends across the rear and upper region of the side supports (56,58), and has a lower rear brace piece (110) which is spaced below the upper brace piece (108) and extends between the rear lower regions of the side supports (56, 58). Support screws (112) having a rectangular catch section (114) may support the brace pieces (108, 110) by the catch sections receiving the brace pieces (108, 110) and the bottom brace piece (110) is supported by the respective catch section having a finger thereof extending through an orifice (120) and the screws (112) extend into the spaced apart vertical studs (106) of the work shop wall (104). The panels are rotatable about a vetical axis through at least 90 degrees of rotation.

EXAMPLE

A tool rack was made having a frame twenty inches wide and eighteen inches high. The frame was hung on a wall with L shaped hooks and used approximately 2.5 square feet of wall space. The frame held five panels using both sides of the panels (both sides of the panels had peg boards) resulting in usable hanging space equal to approximately 20.75 square feet of wall space. All of this wall space footage required only 2.5 square feet of frame footprint area. Additionally, tools hang on the panels can extend past the sides and below the bottom edges of the panels which effectively increase the available square footage of wall space provided by the tool rack. The frame of the rack was made utilizing two pieces of lumber one inch by four inches by twenty inches to form the top plate (cross piece) and the bottom plate (cross piece). The bottom piece is drilled to provide five holes having half inch diameters and being spaced apart four and three eighths inches starting one and a quarter inch from each end and one inch from the front side. A one by three inch rectangular notch is cut out of the back corners of the bottom cross piece.

The top cross piece (plate) is has a rectangular slanted slot which is 0.5 by 0.75 inches in dimension spaced four and three eights inches apart starting 1.25 inches from each end and one inch from the front side. Notches are cut from the ends of the top cross piece as was done for the bottom cross piece.

Two side support pieces 2.5 inches by 1 inch by 18 inches were cut and screwed into the back ends of the top and bottom plates to form a rectangular frame. Two rear brace pieces 1.25 inches by 1 inch by 20 inches were cut and screwed into the back of the top and bottom plates and the two support pieces to give the frame stability and strength. The braces were also used to hang the frame on the L shaped hooks which were screwed into the wall.

The panels were made by using peg boards attached (nailed/screwed) to 0.5 inch by 0.75 inch by 15.5 inch strips and 0.5 by 0.75 by 16 inch strips formed into a rectangle of 15.5 by 16 inches. A top pin is formed by cutting a 0.25 inch diameter dowel to 1.5 inches in length. A bottom pin is formed by cutting a 0.25 inch diameter dowel 0.375 inches in length. Peg boards of 15.5 by 16 inches were nailed on both sides of the strip rectangle. Spacer rods were mounted to every other panel to prevent adjacent panels from rubbing each other as the panel are swiveled. Each panel of the system (assembly) can be lifted into or out of the frame to facilitate the changing the arrangement of the tools. For example, if desired, the most frequently used tool panel may be moved to the center position during any particular project, and then replace when another panel of tools becomes more relevant for another type of project.

What is claimed is:

1. A tool rack assembly comprising:

(a) a frame comprising (i) a top cross piece, (ii) a bottom cross piece, (iii) a left side support extending from said top cross piece to said bottom cross piece, (iv) a right side support extending from said top cross piece to said bottom cross piece, said left sided support being spaced apart from said right side support, (b) a plurality of panels pivotally and removably attached to said frame, said panels each comprising a top pin unit and a bottom pin, said top pin unit being longer than said bottom pin, said top cross piece having a plurality of top holes each having a downwardly forwardly extending bore, said bottom cross piece having a plurality of holes each having a vertical bore, wherein said top pin unit of each panel has a pin which is positioned within a respective top hole, wherein said bottom pin of each panel is positioned within a respective bottom hole.

2. The assembly of claim 1 wherein said top holes are arranged in a V shape having a forward most center hole.

3. The assembly of claim 1 wherein said top holes have cylindrical bores, said top pins being cylindrical, said bores having circular cross-sections having larger diameters than circular cross sections of said cylindrical top pins.

4. The assembly of claim 1 wherein said at least one panel has a spacer rod extending therefrom and a wire insert extending from said panel, said spacer rod extending further from said panel than said wire insert extends from said panel.

5. The assembly of claim 4 wherein said assembly has spacer rods on alternating panels.

6. The assembly of claim 1 wherein each panel has a pair of spaced apart boards, each board having a plurality of peg holes.

7. The assembly of claim 6 wherein said peg holes are arranged in rows and columns.

8. The assembly of claim 6 wherein said panels each have a top strip and a bottom strip between said boards and secured to said boards for maintaining the spaced relationship of the boards.

9. The assembly of claim 8 wherein each of said panels is rotatable about a vertical axis through at least 90 degrees of rotation.

* * * * *